United States Patent [19]

Dunn

[11] 4,353,740

[45] Oct. 12, 1982

[54] CHLORINE EXTRACTION OF GOLD

[76] Inventor: Wendell E. Dunn, Star Rte. 68D, Lead, S. Dak. 57754

[21] Appl. No.: 301,239

[22] Filed: Sep. 11, 1981

[51] Int. Cl.[3] ..... C22B 11/00

[52] U.S. Cl. ..... 75/83; 75/118 R; 75/112; 423/44

[58] Field of Search ..... 75/104, 110, 111–114, 75/118 R, 83; 423/38, 39, 40, 44, 46

[56] References Cited

U.S. PATENT DOCUMENTS

| | | | |
|---|---|---|---|
| 3,159,703 | 12/1964 | Wolcott | 266/147 |
| 3,802,873 | 3/1974 | Bradshaw | 75/118 |
| 3,825,651 | 7/1974 | Heinen et al. | 75/83 |
| 3,834,896 | 10/1974 | Eisele et al. | 75/112 |
| 3,976,760 | 8/1976 | Toussaint | 423/493 |
| 3,988,415 | 10/1976 | Barr | 423/22 |
| 4,086,084 | 4/1978 | Oliver et al. | 75/118 R |
| 4,094,668 | 6/1978 | Yannopoulos | 75/99 |
| 4,209,501 | 6/1980 | Kruesi | 75/111 |

*Primary Examiner*—L. Dewayne Rutledge
*Assistant Examiner*—Christopher W. Brody
*Attorney, Agent, or Firm*—Samuel V. Abramo

[57] ABSTRACT

A process for treating a particulated gold bearing ore to recover the gold therein is disclosed. The process includes roasting the ore to remove sulfides as sulfur dioxide followed by chlorination of the ore at a temperature of about 350° C. in the presence of iron to form a mixture of volatile gold chlorides and volatile gold-iron chlorides in the chlorine off gases followed by condensing the gold compounds by passing the mixture through a salt such as sodium chloride to form a salt melt and separating the gold from the melt.

6 Claims, No Drawings

CHLORINE EXTRACTION OF GOLD

BACKGROUND OF THE INVENTION

1. Field of the Invention

This invention relates to a process for treating gold ores including sulfur containing gold ores and is more particularly directed to a process for recovering gold using a chlorination process wherein the volatile gold compounds formed are removed from the product stream by condensation in a solid salt.

2. Description of the Prior Art

The extraction of gold from its ore is accomplished using the cyanide process. The cyanide process has severe air and water pollution problems which are costly to prevent.

The use of chlorine in the metallurgy of gold could eliminate the water and air pollution problems. The volatization of gold chloride during chloridization or chlorination has been extensively studied. The United States Bureau of Mines described their study fo gold chlorination processes in 1923. More recently, Eisele, Heinam and Fischer obtained in U.S. Pat. Nos. 3,825,651 and 3,834,896 on such a process. An aqueas process is described by Yannopoulos et al. in U.S. Pat. No. 4,094,668.

These processes differ from invention in that they do not use the salt condensation system which effect a simple and complete recovery of gold chlorides from the product stream.

SUMMARY OF THE INVENTION

This invention is a process to recover gold and silver from a gold and silver containing ore comprising the steps of:

(1) grinding the ore, (2) roasting the ground ore in the presence of air or oxygen, (3) contacting the roasted ore, in the presence of iron or an iron salt, with chlorine at elevated temperatures and at a pressure of 1 to 2 atmospheres, and (4) condensing the gold-containing volatile compounds produced in a bed of grandular salt such as an alkali or alkaline metal halide.

Silver chloride is leached from the spent ore by product by conventional means.

Metallic gold is recovered from the salt by conventional means such as dissolving the gold contaning salt mixture in water and treating the solution with metallic zinc to reduce the gold.

DESCRIPTION OF THE PREFERRED EMBODIMENTS

Ores which can be processed by this invention include siliceous pyritic ores. The ore is crushed to a particle size of 20 to 200 mesh. The ground ore is roasted in the presence of air or oxygen. Roasting is done in a reactor where the air or oxygen is passed through the ore or is can be done in a kiln. Roasting can be effectively accomplished using pressures of 1 to 2 atmospheres, absolute. Roasting temperature is of the order of 400° to 550° C. The ore is the degases by means of a vacuum.

Powdered iron or an iron salt is added to the ore in an amount equal to or in slight excess to the amount of gold in the ore, on a mole basis. It may not be necessary to add iron if the ore contains iron in the form which is converted into ferric chloride by the chlorination step of this process. It has been found that iron oxides in the ore are not converted into ferric chloride in this process. The degased ore is contacted with chlorine at a temperature of 300° to 400° C. The time of reaction is about one hour and in a continuous process the average retention time is about one hour.

The exiting chlorine gas, which is used in excess, contains volatilized gold chlorides and volatile gold-iron chloride complex. These gold compounds are separated from the chlorine by being passed through a bed of an alkali or alkaline metal halide such as sodium or potassium chloride to form a salt melt. Excess chlorine is treated with concentrated sulfuric acid, repressurized and recycled in the process. The build-up of inert gases in the recycled chlorine is prevented by condensing a portion of the recycle chlorine.

In a fluidized bed process, the depth of the ore bed subjected to chlorine is 0.5 to 4 feet or higher. The chlorination reaction may be conducted under pressures of 1 to 2 atmospheres, absolute. In order to obtain the maximum recovery of gold from the ore, staged reactors may be used.

The amount of chlorine consumed to made gold by-products is small since the amount of gold in the ore is generally small. Excess chlorine is used in the process. In a fluidized reactor, the flow rate of chlorine that is required to fluidize the bed and is, in general, 0.2 foot per second.

EXAMPLE

A siliceous pyritic ore containing 0.2 troy oz. of gold per ton is ground to an average particle size which passes through a 20 mesh screen. The ore (12 tons) is placed in a fluid bed roaster to produce a static bed of about four feet. Air is passed through the ore at a temperature of 450° C. until sulfides in the ore are converted to sulfur dioxide which passes from the top of the reactor. To the ore which is allowed to cool to a temperature of 350° C. is added 0.1 pound of iron powder. Chlorine is introduced beneath the bed at a rate of 0.2 ft./sec. while the temperature of the bed is maintained at 350° C. Excess chlorine and a mixture of volatile tri-chloride gold iron chloride, gold chloride and other metal chlorides is exited from the top of the reactor and passed through a column of sodium chloride (5pounds). The gold compounds and other metal chlorides form a salt melt from which the gold is separated. The yield of gold is almost 100% of the gold present in the ore.

The process can be conducted continuously by continuously adding roasted ore to a fluidized bed of the ore which is subjected to chlorine and continuously removing a portion of the bed. Staged reactors can be used in a continous process to effect almost complete recover of the gold in the ore.

Similarly, the process can be conducted either batchwise or continuously, in a pulse fashion by passing intermittent charges of chlorine through the bed of ore. The batch process is equally applicable to chlorination of the roasted ore into a kiln.

The chlorinated ore is allowed to cool and then leached using conventional means, for example, such as extraction with a hot 10 M ammonical solution of ammonium sulfate, as described in U.S. Pat. No. 4,094,668 to recover silver chloride formed during the chlorination step. Other silver chloride dissolving substances can be used.

Excess chlorine exiting from the salt column is passed through concentrated sulfuric acid, compressed in an axial flow compressor, and recycled.

While I do not which to be bound to theory it is believed that it is quite feasible to operate my gold recovery process at low temperatures to form the tri-chloride dimer or tri-chloride gold iron complex. Kinetic studies indicate a 25 fold or higher increase in gold-chloride vapor transport in the presence of ferric chloride. This increase in gold-chloride transport is utilized in my low temperature porcess. On the othe hand, it is believed that the breakdown of the $Au_2Cl_6$ complex causes a marked advers effect on the Au to $AuCl_3$ reaction and, therefore, it is only due to the formation of of AuCl or $Au_2Cl_2$, at much higher temperatures which has been reported in the literature, that high temperatures transport of gold chloride is feasible.

What is claimed is:

1. A process for recovering gold from a gold-containing ore comprising the steps of:

(a) grinding the ore, (b) oxidative roasting of the ore in the presence of a gas selected from the group consisting of air or oxygen to remove sulfides in the ore, at an elevated temperature;

(c) chlorinating the ore by contacting the ore with chlorine at a temperature of 300° to 400° C., in the presence of at least one mole or iron per mole of gold present in the ore to convert gold in the ore into volatile gold chloride and gold chloride-iron chloride complex and producing spent ore, (d) passing volatiles from the chlorination step through a halide salt selected from the group consisting of a alkali and alkaline metal chloride, bromide and iodide to separate volatilized gold values to form a halide salt-gold chloride mixture, and (e) separating metallic gold from the halide salt.

2. The process of claim 1 comprising grinding the ore to a particle size of 20 to 200 mesh, the roasting step (b) is conducted at a temperature of 400° to 550° C., the roasted ore is subjected to a vacuum to degas the roasted ore, the chlorination step (c) is conducted at a temperature of 350° C. in the presence of 1 to 3 moles of iron, ferric chloride, and ferrous chloride per mole of gold in the ore subjected to chlorination.

3. The process of claim 2 wherein roasting and chlorination of the ore is concluded as a pressure of 1 to 2 atmospheres, absolute.

4. The process of claims 2 or 3 wherein the spent ore is leached to separate from the spent ore silver chloride.

5. The process of claim 4 wherein the spent ore is leached with an ammonical solution.

6. The process of claim 1 wherein metallic gold is separated by dissolving the halide salt-gold chloride mixture in water followed by contacting the solution formed thereby with a metal selected from the group consisting of iron, tin, zinc, aluminum and copper.

* * * * *